United States Patent [19]

Merz

[11] 4,014,120

[45] Mar. 29, 1977

[54] PICTURE MOUNT AND SUPPORT

[75] Inventor: David S. Merz, Wellesley Hills, Mass.

[73] Assignee: Polaroid Corporation, Cambridge, Mass.

[22] Filed: Nov. 8, 1974

[21] Appl. No.: 522,141

[52] U.S. Cl. ..... 40/152.1; 40/124.1; 248/459

[51] Int. Cl.[2] ..... G09F 1/12

[58] Field of Search ..... 248/459, 472; 40/152.1, 40/124.1, 159

[56] References Cited

UNITED STATES PATENTS

| | | | |
|---|---|---|---|
| 143,878 | 10/1873 | Caterson | 40/159 |
| 547,377 | 10/1895 | Gillbee | 40/152.1 |
| 2,253,814 | 8/1941 | Sames | 40/159 |
| 3,357,671 | 12/1967 | Ketterer | 40/124.1 X |
| 3,707,791 | 6/1973 | Levy | 40/152.1 X |

FOREIGN PATENTS OR APPLICATIONS

| | | | |
|---|---|---|---|
| 113,330 | 2/1918 | United Kingdom | 248/459 |

*Primary Examiner*—Louis G. Mancene
*Assistant Examiner*—Wenceslao J. Contreras
*Attorney, Agent, or Firm*—Esther A. H. Hopkins

[57] ABSTRACT

An easel backed frame for photographs and the like comprising a front apertured frame and an easel back comprising four connected planar members.

3 Claims, 5 Drawing Figures

PICTURE MOUNT AND SUPPORT

The present invention is directed toward an attractive, structurally sound easel backed frame for supporting and displaying a picture. The frame is light weight, economical to manufacture and ship, and easily assembled.

Accordingly, the objects of this invention are to provide an easel backed frame: which is structurally sound; results in little waste of the raw material of which it is comprised; and is easily assembled.

Other objects will in part be obvious and will in part appear hereinafter.

The invention accordingly comprises the apparatus possessing the construction of components which are exemplified in the following detailed disclosure, and the scope of the application of which will be indicated in the claims.

For a fuller understanding of the nature and objects of the invention, reference should be had to the following detailed description taken in connection with the accompanying drawings wherein.

Picture frames comprising easel backs and easel backs themselves are known in the art. See, for example, U.S. Pat. Nos. 3,355,828 and 3,707,791. Such frames are either designed to provide for insertion into a channel a picture, cardboard, glass and backing insertion, as in aforesaid U.S. Pat. No. 3,707,791, or are designed as in aforesaid U.S. Pat. No. 3,355,828 to use as a support material cut from the backing member.

The present invention has numerous advantages over the cited art and combines attractive appearance, structural stability in alternate modes of orientation, ease of assembly, low waste of production materials and light weight.

DESCRIPTION OF THE PREFERRED EMBODIMENT

Figure 1:
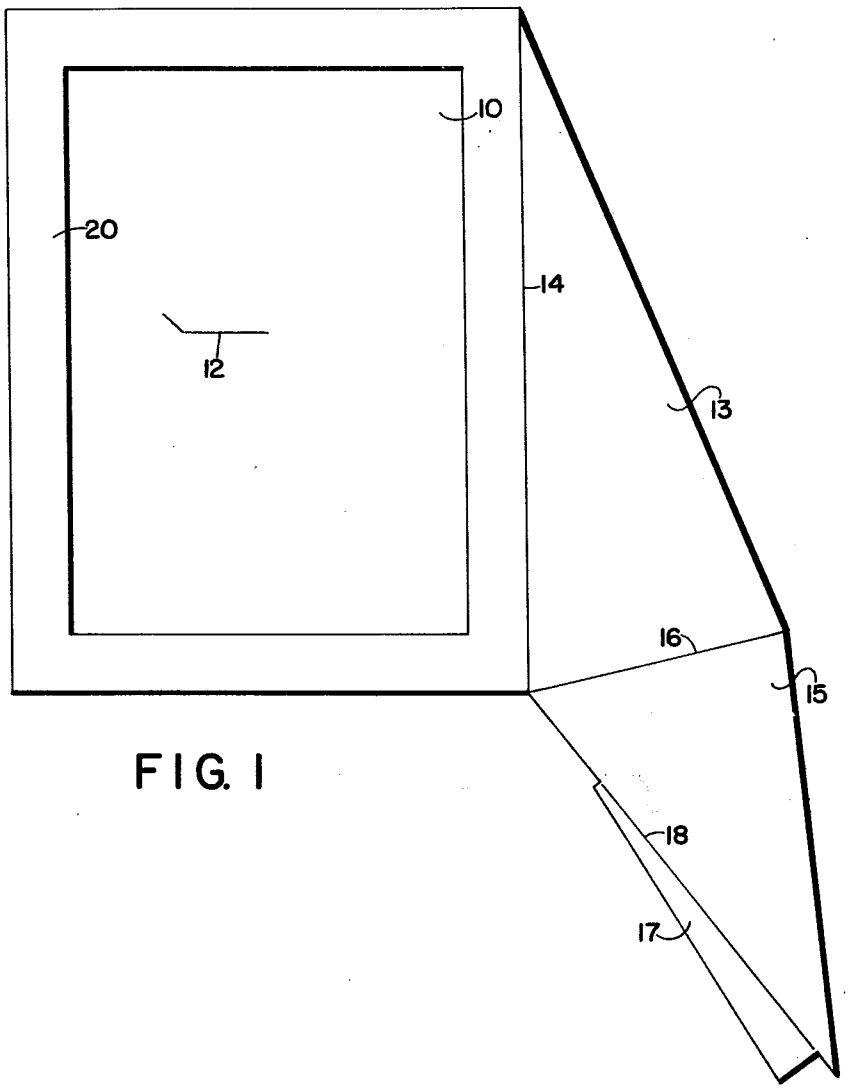
FIG. 1 is a face view of the preferred embodiment of the easel backed frame unfolded.

Referring first to FIG. 1 there is shown the centrally apertured frame 20 which provides a window through which a picture placed between a first substantially planar member 10 and frame 20 may be viewed. First planar member 10 and frame 20 are adhesively attached to each other and their outer edges are coextensive. Slit 12 is shown in first planar member 10. Connected to edge 14 of first planar member 10 is a second planar member 13 which, in the preferred embodiment, is triangular in shape and depends from the entire edge 14. Connected to edge 16 of second planar member 13 is a third planar member 15 which, in the preferred embodiment, is triangular in shape and depends from the entire edge 16. Connected to edge 18 of the third planar member 15 is a fourth planar member 17 which, in the preferred embodiment, is trapezoidal in shape and depends from only a portion of edge 18. Edges 14, 16 and 18 act as hinges which facilitate folding of the easel back and may be in the form of scorelines between attached planar members.

Figure 2:
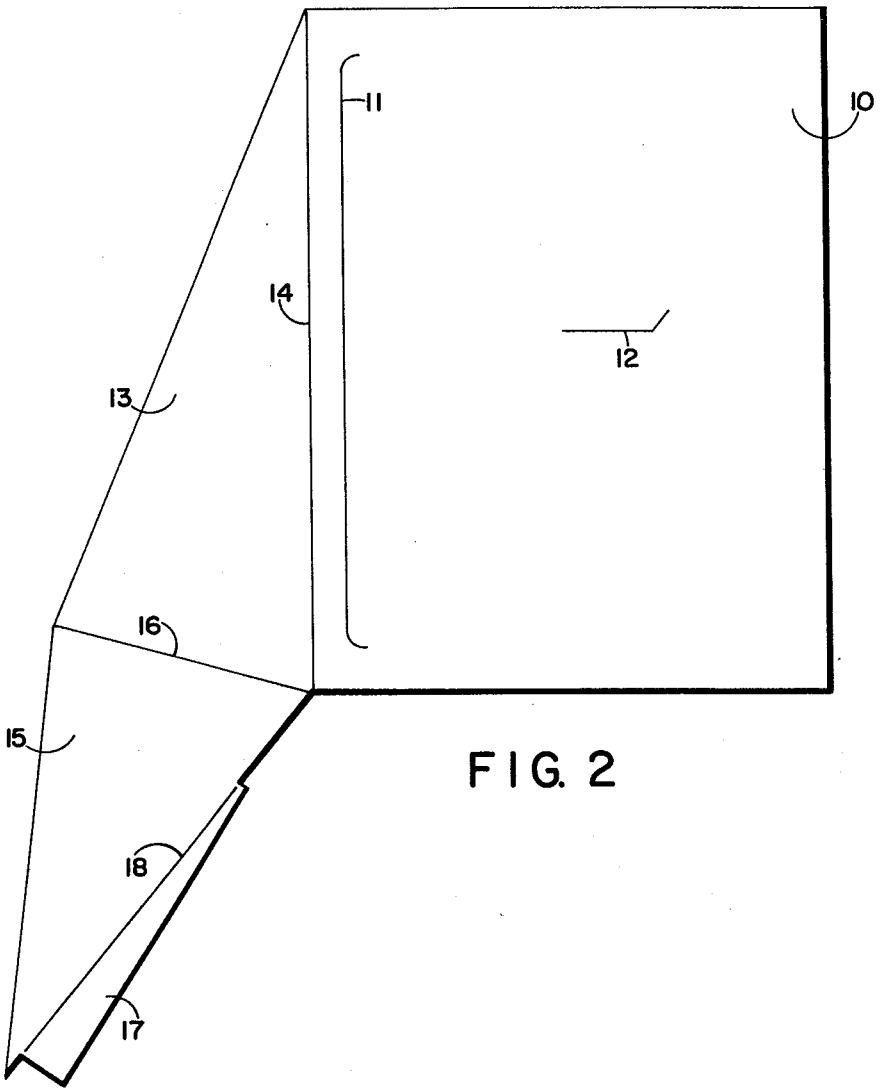
FIG. 2 is a back view of the unfolded easel backed frame of FIG. 1.

FIG. 2 is a rear view of FIG. 1 and shows the location of slits 11 and 12. The picture for display is placed within the easel backed frame through slit 11, which is parallel to edge 14, spaced inward from said edge and extends at least the length of a side of the aperture in frame 20. Slit 12 is the opening with which a portion of fourth planar member 17 coacts to form a rigid structure upon bending the various planar members at hinges 14, 16 and 18. Slit 12 comprises two obliquely intersecting slashes. It can be seen from FIG. 2 that the easel back may be economically cut from large sheets of stock without excessive waste since the outer perimeter of the easel back, though irregular, permits little excess material between adjacent, unfolded easel backs, thus permitting maximum yield.

Figure 3:
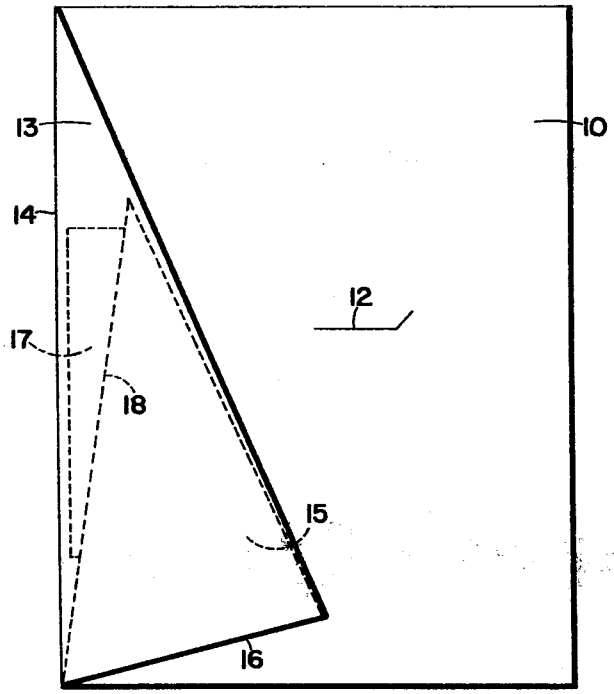
FIG. 3 is a back view of the easel backed frame of FIG. 1 folded for shipping.

FIG. 3 illustrates the compactness with which the easel backed frame of the present invention may be folded for shipping. In this configuration the edges 14 and 16 act as hinges and have been folded completely, but the edge 18 is not folded so that planar members 15 and 17 are in the same plane.

Figure 4:
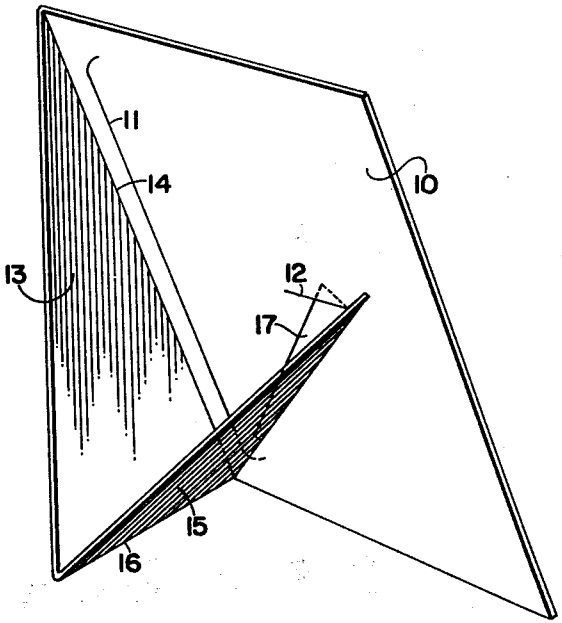
FIG. 4 is a perspective rear view of the easel backed frame of FIG. 1 set up for support and display.

The easel backed frame set up for display and support is shown in FIG. 4, which illustrates how the end of fourth planar member 17 fits into slit 12 to provide support for the frame. In this configuration the edges 14, 16 and 18 each acts as a hinge.

Figure 5:
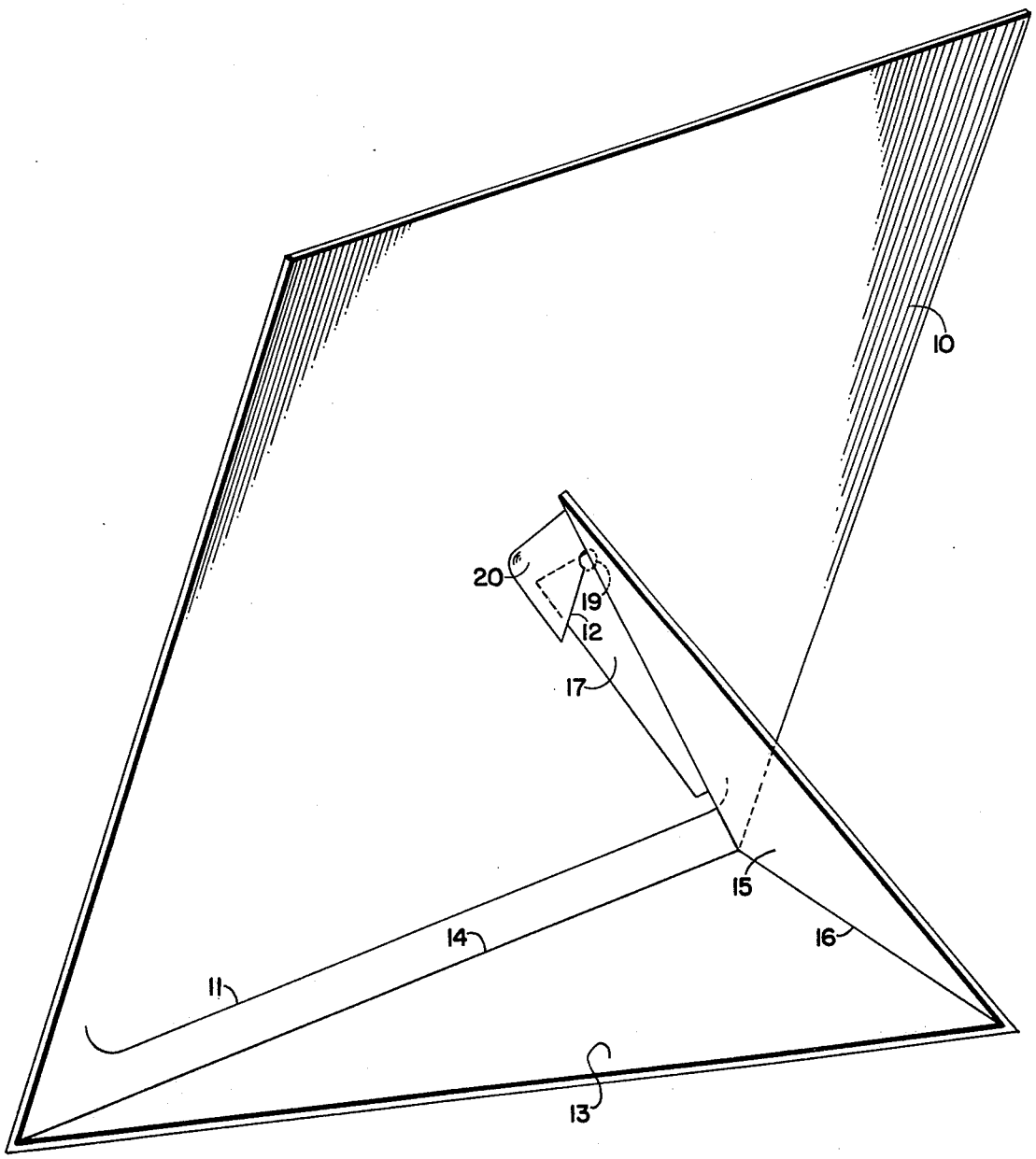
FIG. 5 is a perspective rear view of a preferred embodiment of the easel backed frame of this invention in an alternate mode of orientation.

A perferred embodiment of the easel backed frame set up for display and support in an alternate mode of orientation is shown in FIG. 5 which illustrates how the end of fourth planar member 17 fits through slit 12 and rests in pocket 20, pocket 20 having been formed in the manufacturing process to allow, upon assembly, the end of fourth planar member 17 to enter substantially the plane of first planar member 10 so that a planar photograph inserted in the easel backed frame rests against a substantially planar support and is not distorted. Hole 19 is positioned to serve as a locator for second slit 12 for insertion of the end of fourth planar member 17 into said second slit.

It is to be understood that the only restriction on the shape of the apertured frame 20 and the coextensive first planar member of the easel back is that there be at least three edges. Easel backed frames of shapes other than rectangular are contemplated by this invention. Although the preferred embodiment of this invention envisions second planar member 13 and third planar member 15 as triangular in shape and member 13 as having edge 14 coextensive with the entire edge of first planar member 10 and edge 16 coextensive with the entire edge of third planar member 15, it is, of course, understood that other polygonal shapes are contemplated and that the edges of adjacent members need not be coextensive.

Since certain changes may be made in the above produce without departing from the scope of the invention herein involved, it is intended that all matter contained in the above description or shown in the accompanying drawings shall be interpreted as illustrative and not in a limiting sense.

What is claimed is:

1. An easel backed frame for displaying and supporting a photograph or the like comprising:

a. a rectangular frame comprising a panel which is centrally apertured to provide a window through which a photograph or the like placed behind said panel may be seen;

b. an easel back comprising:

i. a rectangular first substantially planar member having a perimeter coextensive with said frame and attached to said frame;

ii. a first slit in said first planar member parallel to a first edge thereof and extending approximately ninety percent of the distance between the edges thereof forming said first edge;

iii. a second slit in said first planar member said second slit comprising two obliquely intersecting slashes, the first of said two slashes being generally perpendicular to, but not intersecting said first slit, the intersection of said two slashes being approximately two-thirds of the prependicular distance from said first edge of said first planar member;

iv. a triangular second planar member, one edge of which is hinged to and coextensive with said first edge of said first planar member;

v. a triangular third planar member, one edge of which is hinged to and coextensive with one edge of said second planar member other than its edge which is coextensive with said first edge of said first planar member; and vi. a fourth planar member, one edge of which is hinged to and common with a part of one edge of said third planar member other than its edge which is common with said second planar member, a portion of which is engageable with said second slit thereby forming a rigid structure capable of supporting a picture frame.

2. The invention of claim 1 wherein said members of said easel back are all formed integrally with one another with the hinges being in the form of scorelines for localized bending between the members.

3. The invention of claim 2 wherein said substantially planar first member contains a depression contiguous to said second slit, said depression coacting with said second slit to form a pocket.

* * * * *